United States Patent [19]

Pezzoli

[11] Patent Number: 4,624,288

[45] Date of Patent: Nov. 25, 1986

[54] MECHANISM TO CONTROL THE MOVEMENTS OF WEFT INSERTION MEMBERS IN SHUTTLELESS WEAVING LOOMS

[75] Inventor: Luigi Pezzoli, Leffe, Italy

[73] Assignee: Vamatex S.p.A., Villa Di Serio, Italy

[21] Appl. No.: 740,035

[22] Filed: May 31, 1985

[30] Foreign Application Priority Data

Jun. 7, 1984 [IT] Italy ..... 21290 A/84

[51] Int. Cl.[4] ..... D03D 47/00

[52] U.S. Cl. ..... 139/449; 74/59; 74/89.15

[58] Field of Search ..... 139/449; 74/56, 57, 74/58, 59, 89.15

[56] References Cited

U.S. PATENT DOCUMENTS 4,052,906 10/1977 Genini ..... 74/89.15

4,535,642 8/1985 Ohmura ..... 74/58

*Primary Examiner*—Henry S. Jaudon

*Attorney, Agent, or Firm*—Young & Thompson

[57] ABSTRACT

In a mechanism to control the movements of the weft carrying grippers in shuttleless weaving looms—of the type wherein a gearwheel controlling the grippers carrying strap is caused to rotate forward and backward by a variable pitch cam screw, passing longitudinally through a slider which moves forward and backward along a forced rectilinear path—the slider carries structure engaging the threading of said screw and adapted to cause the rotation thereof, comprising opposed pairs of oscillating sliding blocks.

2 Claims, 4 Drawing Figures

MECHANISM TO CONTROL THE MOVEMENTS OF WEFT INSERTION MEMBERS IN SHUTTLELESS WEAVING LOOMS

BACKGROUND OF THE INVENTION

In general mechanics, and in many types of applications covering the most different fields of technique, there are known to be screw and nut mechanisms for motion transmission. These mechanisms generally use constant pitch screws. In some cases, however, when special motion laws have to be followed, the mechanisms adopted are of the type with variable pitch screws.

A particular type of mechanism of this kind is that already adopted since some years to obtain the forward motion of weft carrying members (grippers or like) in the shed of shuttleless weaving looms (or looms with continuous weft feed). It is a mechanism wherein the reciprocating rotary motion of a gearwheel controlling the movements of the grippers carrying strap is obtained thanks to the similar motion of a variable pitch cam screw which passes through a slider alternately moving along a rectilinear path, means being provided to engage the slider with the screw, so as to produce the rotation of this latter in consequence of the rectilinear motion of the first, and viceversa.

In the constructions known up to date, said means for engaging the slider with the screw have always consisted of rolling members, especially of rollers carried by the slider and mating with the threading of the cam screw. This solution, which has provided satisfactory results and has allowed to considerably improve the performances of shuttleless gripper looms, has recently proved inadequate on account of the ever rising requirements to increase the speed of looms. Wear was in fact becoming prohibitive at the increased running speeds of the machine, probably due to the reduced rolling, or lack of rolling, of said rollers on the screw threading above certain speeds.

The studies made by the Applicant to overcome this drawback have discovered that, by replacing the known rolling means (having very reduced surfaces to bear on the screw threading) with oscillating sliding blocks having a suitable profile (adapted to mate with the screw threading, in correspondence of very wide bearing surfaces), it has been possible to surprisingly solve any problem connected with the speed increases of the machine, reducing wear—even at very high running speeds of the mechanism—to fully acceptable values.

SUMMARY OF THE INVENTION

The present invention hence concerns a mechanism to control the movements of weft carrying grippers in shuttleless weaving looms—of the type wherein a gearwheel controlling the grippers carrying strap is caused to rotate forward and backward by a variable pitch cam screw, passing longitudinally through a slider which moves forward and backward along a forced rectilinear path—characterized in that, said slider carries means for engaging the threading of said screw and adapted to cause the rotation thereof, comprising opposed pairs of oscillating sliding blocks.

Preferably, in order to engage the cam screw of the device, said sliding blocks are made with an involute surface, adapted to mate—also thanks to their oscillation—with the threading of said screw.

BRIEF DESCRIPTION OF THE DRAWINGS

The invention will now be described in further detail, by mere way of example, with reference to the accompanying drawings, which represent a preferred embodiment thereof and in which.

DESCRIPTION OF THE PREFERRED EMBODIMENT

Figure 1:
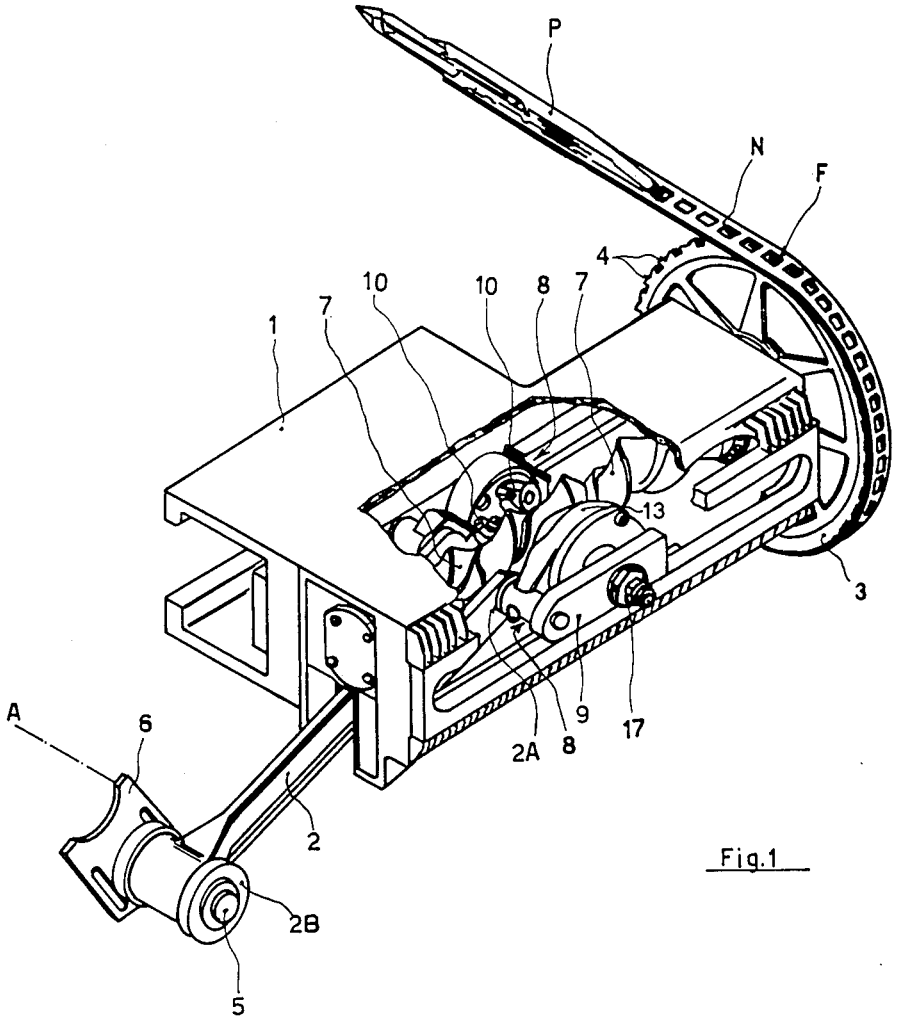
FIG. 1 is an assembly view of the mechanism according to the invention.

The mechanism for controlling the forward movement of the grippers P in a weaving loom (not shown) with continuous weft feed, is similar to that disclosed in U.S. Pat. No. 4,052,906, over which this invention is an improvement. The mechanism comprises (FIG. 1) a sturdy metal framework 1, containing mechanical members adapted to convert a rectilinear reciprocating motion into a rotary motion (for instance, of the small end of a connecting rod 2 or, alternatively, of a cam transmission operating said members) and a gearwheel 3, to which oscillation is imparted by said members and the teeth 4 of which, engaging the slits f of the strap N controlling the gripper P, produce the motion of said strap. The connecting rod 2 has its small end 2A adapted to perform merely a reciprocating motion along a rectilinear path, while its big end 2B is engaged on the crank pin 5 of a slide 6, which is mounted on a crank forming with the connecting rod 2 a connecting rod-crank unit. The crank (not shown) with the slide 6 rotates about a shaft A (the axis of which is indicated in FIG. 1 by dashed lines), which can be the main shaft of the weaving loom, or else a secondary shaft rotating at the same speed as the main one. (Alternatively to the connecting rod-crank unit, the loom shaft may control a cam transmission).

According to the invention, the members for converting the rectilinear reciprocating motion of the small end 2A of the connecting rod 2 into oscillation of the gearwheel 3 essentially comprise, within the framework 1: a cam screw 7, having one end keyed to the gearwheel 3 and the other end mounted freely rotatable; a slider 8, traversed by said screw and moved parallely thereto thanks to the action of the connecting rod 2 connected to it at 2A; a pair of sliding blocks 9, fixedly connected to the slider 8 and slidable in guides of the framework 1, parallel to the cam screw 7; and pairs of sliding blocks 10, carried by said slider and adapted to establish an engagement between the slider 8 and the threading of the screw 7, causing the rotation of said screw 7 when the slider 8 moves along its own rectilinear path.

Figure 2:
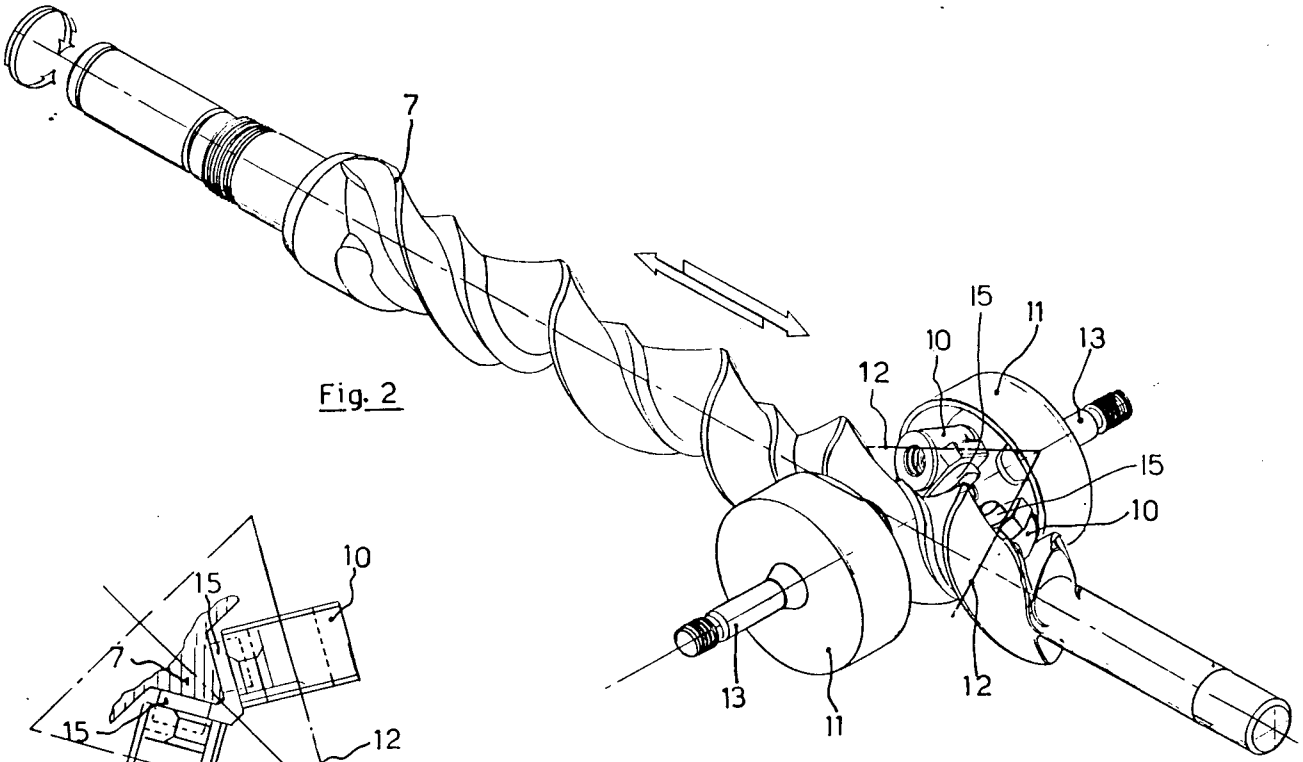
FIG. 2 shows a detail of the variable pitch cam screw and of two symmetrical pairs of sliding blocks (the slider not being shown) in engagement with the threading of said screw.
Figure 3:
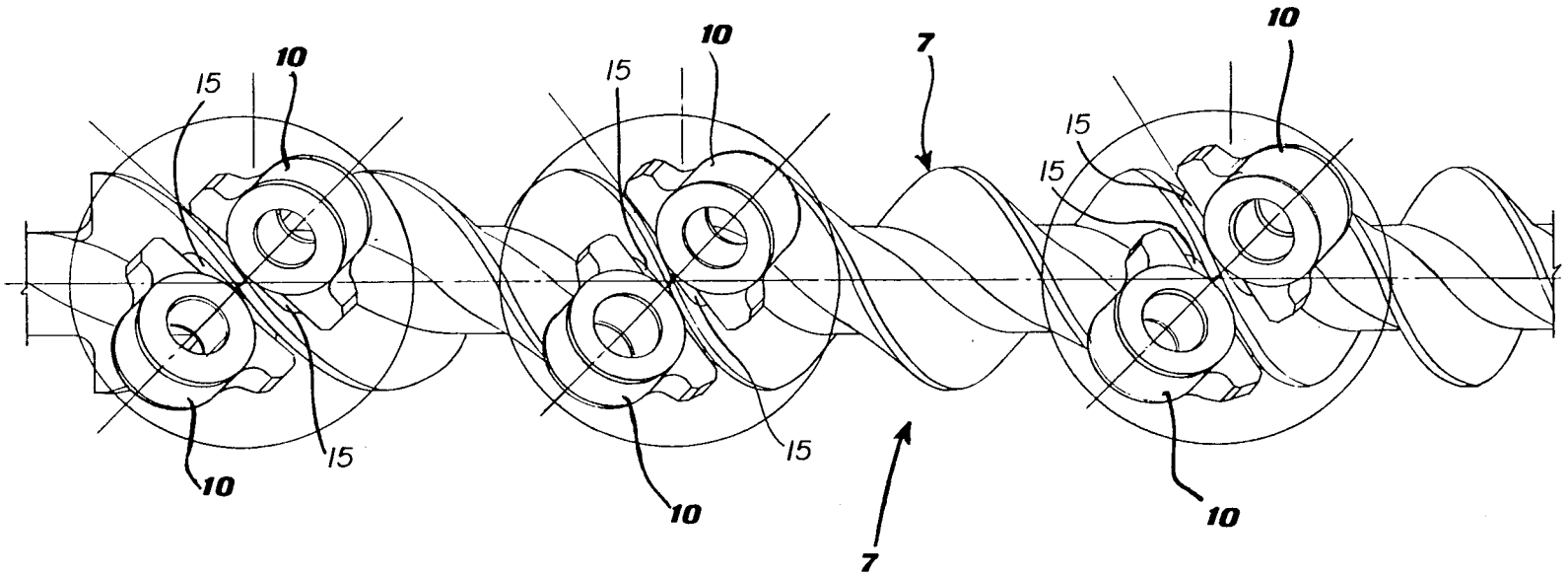
FIG. 3 is a front view detail showing the engagement of several pairs of sliding blocks with the cam screw.

According to the invention, the sliding blocks 10 are mounted in opposed pairs (FIG. 2), each in strictly mating engagement with the threading of the cam screw 7 (FIG. 3). The sliding blocks are mounted (FIG. 2) inside bushings 11 and are adapted to oscillate about axes 12 oppositely inclined at acute angles in respect of axial pins 13, by which said bushes are fixed to the slider 8 perpendicularly to the axis of the screw 7. The sliding blocks 10 (FIGS. 3 and 4) comprise a metal structure 14 having the outer surface 15, engaging the threading of the screw 7, with an involute profile, which allows them to mate—thanks to the oscillations of the sliding blocks—with the surfaces of said screw threading, so as to establish therewith a particularly efficient cooperation. In fact the sliding blocks 10 continuously adapt themselves to the varying of the screw thread form, thereby providing—at each instant of the sliding block-screw engagement—a contact surface having bending radiuses which are equal in sign and have similar values to those of said screw. The engagement thereby obtained comprises a bearing surface which is very much wider than in the known mechanisms using rolling engagement means, particularly steel rollers, whereby pressures are accordingly reduced and thus also wear.

To give an idea of the results obtained with the arrangement according to the invention, it is sufficient to remark that, while after two weeks, at a rate of 24 hours per day, a known-type roller mechanism breaks down—at a very high specific testing speed—after having exceeded maximum acceptable wear; but in the sliding block mechanism according to the invention there are no more problems of wear, since the wear has been reduced to values which make the mechanism last more than 20,000 hours at the same speed.

Figure 4:
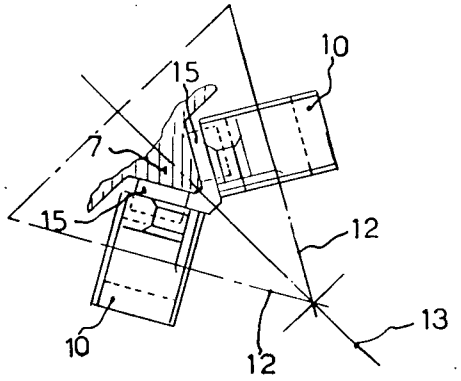
FIG. 4 is a part section view of the engagement shown in FIG. 3.

The behaviour of the sliding blocks is clearly shown in FIGS. 3 and 4, which evidence their perfect mating—by oscillation about their axes—with the thread form of the screw 7, which they reproduce with their own involute surfaces 15, thereby realizing the widest and most efficient cooperation, in spite of the screw pitch being variable.

It is to be understood that there may be other practical embodiments of the invention, falling within the protection scope of the same. For instance, instead of having a metal structure, the sliding blocks can be made of suitable synthetic plastic material, or they can have a composite metal-metal or metal-plastic structure, wherein the involute surface engaging the screw threading is obtained on inserted elements.

I claim:

1. In a mechanism to control the movements of weft insertion members in the shed of shuttleless weaving looms of the type wherein a gearwheel controlling a gripper carrying strap is caused to rotate forward and backward by a variable pitch cam screw passing longitudinally through a slider which moves forward and backward along a rectilinear path; the improvement in which said slider carries means for engaging the thread of said screw and adapted to cause the rotation thereof, comprising opposed pairs of sliding blocks engaging opposite sides of the thread of the screw, and means mounting the blocks for oscillating movement about axes inclined at opposite acute angles to an axis perpendicular to the axis of the screw.

2. Mechanism as in claim 1, wherein the sliding surfaces of said blocks have an involute profile that mates with the threading of the cam screw.

* * * * *